US005607728A

United States Patent [19]

Bremmer et al.

[11] Patent Number: 5,607,728

[45] Date of Patent: Mar. 4, 1997

[54] ROLLER COATING SYSTEM FOR IMPREGNATION OF MULTI-FILAMENT WEB WITH RESIN, AND METHOD OF MAKING A FIBER/RESIN COMPOSITE MATERIAL

[75] Inventors: Jonathan W. Bremmer, Rocky Hill; Martin C. Cosgrove, Harwinton; Bernard M. Malofsky, Bloomfield, all of Conn.

[73] Assignee: Loctite Corporation, Hartford, Conn.

[21] Appl. No.: 514,043

[22] Filed: Aug. 11, 1995

[51] Int. Cl.[6] ..... B05D 1/28

[52] U.S. Cl. ..... 427/428; 427/359; 427/369; 118/110; 118/112; 118/118; 118/123; 118/244; 118/246; 118/248; 118/249; 118/252; 118/258; 118/262

[58] Field of Search ..... 118/244, 246, 118/248, 249, 252, 258, 262, 110, 112, 118, 123; 427/428, 359, 369

[56] References Cited

U.S. PATENT DOCUMENTS

| | | | |
|---|---|---|---|
| 1,955,414 | 4/1934 | Dickhaut | 118/118 |
| 3,186,861 | 6/1965 | Smith et al. | 118/112 |
| 3,931,786 | 1/1976 | Teed | 118/246 |
| 4,048,952 | 9/1977 | Peterson et al. . | |
| 4,123,569 | 10/1978 | Peterson et al. | 118/246 |
| 4,267,007 | 5/1981 | Kellogg . | |
| 4,672,705 | 6/1987 | Bors et al. | 118/246 |
| 4,892,764 | 1/1990 | Drain et al. . | |
| 5,368,893 | 11/1994 | Sommer et al. . | |

*Primary Examiner*—Shrive Beck
*Assistant Examiner*—David M. Maiorana
*Attorney, Agent, or Firm*—Steven J. Hultquist

[57] ABSTRACT

An apparatus for coating a web by contact with a transfer roll partially immersed in a reservoir of coating material and rotated into resin-transferring contact with the web on a first main web surface thereof. The web in passage away from the transfer roll is contacted on a second main surface of the web, the second main surface being opposite the first main surface of the web, by a medial main cylindrical portion of a stepped squeegee roll comprising a medial main cylindrical portion of a first relatively smaller diameter, and marginal shoulder portions each of a second relatively larger diameter in relation to the diameter of the medial main cylindrical portion. The stepped squeegee roll is tensionally biased toward, but in spaced relationship to the transfer roll, being maintained in tensionally biased relationship by spring or other tensionally biasing means, to limit the coating material thickness on the web.

11 Claims, 1 Drawing Sheet

ROLLER COATING SYSTEM FOR IMPREGNATION OF MULTI-FILAMENT WEB WITH RESIN, AND METHOD OF MAKING A FIBER/RESIN COMPOSITE MATERIAL

BACKGROUND OF THE INVENTION

1. Field of the Invention

The present invention generally relates to an apparatus and method for coating an elongate web, such as a multi filament web, with a substantially uniform coating of a resin or other flowable material along the length of the web.

2. Description of the Related Art

The impregnation of web and sheet-form materials with a wide variety of coating materials, as for example resinous materials of various types, is well known and established in the art.

A primary problem experienced in coating web materials with resin formulations is the difficulty of accurately controlling the amount and uniformity of thickness of the resin applied to the web material, since the uniformity of the applied material and its thickness are often critical in terms of the cost, efficacy and appearance of the of the final product.

Spraying application techniques frequently cannot be employed to coat the web, because the area of extent of the web is such that multiple coating spray heads are required to cover the entire area and the overlap and interference between the spray patterns of the respective heads cause non-uniformity of thickness which is unacceptable in the final coated web product. Alternatively, if a spray head of sufficient spatial "throw" capacity to cover the entire web is employed, there is significant losses of the coating material at the margins of the web, and such losses are in fact also present when multiple spary heads are utilized. These losses not only lower the efficiency of the process in terms of the amount of the originally provided coating material which is used, but present significant effluent disposal and/or recycling problems.

In view of these problems, and in instances where is it desired to coat an elongate web in a continuous process, wherein the web is translated through the process system from a supply roll or other source, to a take-up roll or other collection means, it is advantageous to utilize a transfer roll arrangement, in which a rotating drum is partially immersed in a supply vessel containing a volume of the coating material, as a "bath" of the coating material which then is contacted by the circumferential surface of the transfer roll to transfer coating material from the bath to such surface. With continued rotation of the transfer roll, the resin-beating surface is presented at an upper portion of the rotation path, where it is contacted with the continous web, to effect transfer to the web of the resin material from the surface of the roll.

Although such transfer roll process achieves significantly reduced levels of material losses relative to spray processes, it nonetheless is frequently difficult to accurately and reproduceably control the amount and thickness of the coating material which is applied by the transfer roll. The art therefore has continued to seek improved means and methods for improving the transfer roll process system.

U.S. Pat. No. 5,368,893 issued Nov. 29, 1994 to H. Sommer et al. discloses a coating device which includes a transfer roll engaging a web and transferring coating material to it from a source reservoir. In the disclosed apparatus, a roller squeegee bar formed with a rotating peripheral surface including a plurality of peripheral rises and recesses, bears against the surface of the transfer roll. An air blade downstream of the transfer roll controls final thickness of the coating material on the web. Because the air blade acts so far downstream from the transfer roll, material that is excess must be recirculated in order to reach the transfer reservoir. In addition, no control over the amount of coating material applied to the web exists during the actual transfer of the coating material (from the transfer roll) except as provided by the fixed squeegee bar.

U.S. Pat. No. 4,267,007 issued May 12, 1981 to C. W. Kellogg describes a device for resin application to a multi filament web using a transfer roll. The apparatus disclosed in this patent comprises a mandrel, means for rotatably mounting the mandrel, positioned parallel and in space relationship to the mandrel, and a reciprocating carriage. Variable speed rotation means couple the drive to the mandrel, and effect reciprocation of the carriage at a selected velocity.

While there are guide rolls upstream mad downstream of a transfer roll in the Kellogg system, they are fixedly positioned and no means are provided for adjusting the web angle or the amount of coating material applied to the web. Further, no structure or elements are provided for controlling the amount of resin on the transfer roll.

U.S. Pat. No. 4,672,705 issued Jun. 16, 1987 to H. Bors, et al. describes a transfer roll process system in which a guide roller is placed upstream of the transfer roll. The roll is counterweighted but cannot be adjusted to vary the angle of web contact and to control the amount of coating material applied to the web. Further, such system provides no control of the amount of coating material on the transfer roll.

U.S. Pat. No. 4,048,952 issued Sep. 20, 1977 to Glenn E. Peterson, et al. describes apparatus for inking fabric webbing utilizing a transfer roll, two fixed guide rolls, and a fixed doctor blade, but no other means for controlling the amount of ink applied to the fabric.

U.S. Pat. No. 3,186,861 issued Jun. 1, 1965 to J. W. Smith et al. discloses a process system for producing pressure sensitive record paper in which a guide bar is positioned in proximity to the applicator roll. The coated paper is passed around a backing roll and is acted on by an air knife which removes the excess coating material which collects in an underlying pan, from which it can be recycled to the supply pan feeding the transfer roll.

Accordingly, it is an object of the present invention to provide an improved transfer roll system for coating of webs, which provides effective and accurate adjustability of the amount of coating material applied to the web from the transfer roll and which comprises means to readily adjustably control the angle of contact of the web against the transfer roll to thereby further control the amount and rate of uptake of coating material being applied to the web.

Other objects and advantages of the invention will be more fully apparent from the ensuing disclosure and appended claims.

SUMMARY OF THE INVENTION

The present invention relates to an apparatus for coating a web by contact with a transfer roll partially immersed in a reservoir of coating material and rotated into resin-transferring contact with the web.

In one aspect, the invention relates to a web coating apparatus comprising a rotatable transfer roll having an outer surface with which the web to be coated is contacted on a first main surface of the web. The transfer roll is partially immersed at a lower portion thereof in a reservoir of a fluid coating material, which during its rotation presents to the web an outer surface bearing fluid coating material adhering to the transfer roll and in turn transferrable to the first main surface of the web by contact therewith as the web is translated by motion web translation means over the outer surface of the transfer roll.

The web in passage away from the transfer roll is contacted on a second main surface of the web, the second main surface being opposite the first main surface of the web, by a medial main cylindrical portion of a stepped squeegee roll comprising a medial main cylindrical portion of a first relatively smaller diameter, and marginal shoulder portions each of a second relatively larger diameter in relation to the diameter of the medial main cylindrical portion. The stepped squeegee roll is tensionally biased toward, but in spaced relationship to the transfer roll, being maintained in tensionally biased relationship by spring or other tensionally biasing means, to limit the coating material thickness on the web.

The apparatus broadly described above may further comprise a spring-loaded or otherwise tensionally biased doctor roll, comprising a medial main cylindrical portion of a first relatively smaller diameter, and marginal shoulder portions each of a second relatively larger diameter in relation to the diameter of the medial main cylindrical portion, in bearing contact at the marginal shoulder portions with the outer surface of the transfer roll, to thereby controllably establish coating material thickness on the transfer roll outer surface.

The apparatus broadly described hereinabove may further comprise a wrap roll with which the web is contacted, on the second main web surface, in approach to the transfer roll. The wrap roll is mounted in spaced relation to the transfer roll, as for example on a pivot arm which is selectively adjustable, to control the arc of contact of the web with the outer surface of the transfer roll.

In another specific aspect, the invention relates to an apparatus for coating with a coating material a web having upper and lower main web surfaces, wherein the apparatus comprises:

a reservoir for containing the coating material;

a rotatable transfer roll with an outer surface for transferring coating material thereon to a web contacting the roll during rotation thereof, with the transfer roll being mounted in the reservoir with a lower portion of the outer surface arranged for immersion in coating material contained therein, and so that upon rotation of the transfer roll a lower portion of the outer surface after immersion in the coating material is rotated to a non-immersed web coating application position of the transfer roll for contacting the web;

a drive assembly for rotating the transfer roll;

the web being arranged for translation from an upstream supply position to a downstream position along a processing path, so that the lower main web surface along the processing path contacts the transfer roll at the non-immersed web coating application position of the roll;

a wrap roll assembly comprising (i) a wrap roll positioned upstream in spaced relationship to the transfer roll and in contact with the upper main web surface, and (ii) wrap roll angular positioning means for adjustably fixing an arc of contact of the web against the transfer roll at the non-immersed web coating application position of the transfer roll;

a stepped squeegee roll mounted so as to be tensionally biased toward, but in spaced relationship to the transfer roll, for limiting coating material thickness on the web; and a stepped doctor roll mounted so as to be tensionally biased toward, and in shoulder contacting relationship to the transfer roll, for controllably establishing coating material thickness on the transfer roll outer surface.

The stepped squeegee roll and the stepped doctor roll in the foregoing apparatus may be tensionally biased toward the transfer roll in any suitable manner, such as for example by spring biasing or other directionally tensional means which effect the tensional relationship between the squeegee roll and/or doctor roll, and the transfer roll. As a specific example, each of the stepped rolls may be interconnected at their end portions by springs to an axle of the transfer roll, in sliding contact with such axle, as for example by a sliding collar or bearing fixture mounted thereon, and having the springs coupled thereto, so that the springs tensionally direct the respective stepped rolls toward the transfer roll..

As used herein, the term "stepped" in description of the rolls utilized in the coating apparatus of the invention, means that the roll is formed with medial main cylindrical portion of a first relatively smaller diameter, and marginal shoulder portions each of a second relatively larger diameter in relation to the diameter of the medial main cylindrical portion.

In the apparatus of the invention, the squeegee roll and the doctor roll may each be mounted for selective angular orientation about the periphery of the transfer roll, to thereby vary the positional relationship of the respective squeegee and doctor rolls to the transfer roll, as necessary or desirable in a given end use application of the invention. For example, the squeegee and doctor rolls may each be mounted on a pivot arm assembly, which is selectively adjustable in the orientation of the pivot arm component thereof, and lockable in a selected position.

Further, the coating apparatus of the invention may be of a generally unitary material is disposed, and with such frame or base structure having upwardly extending side and end plates, with the respective roll elements of the apparatus being mounted on axle members which are journalled or otherwise supportively reposed in mounted positions on the side plates of the frame or base structure, as hereinafter more fully described.

In a process aspect, the present invention relates to a process for coating a web, having upper and lower main web surfaces, with a coating material on a transfer roll with an outer surface partially immersed at a lower portion thereof in a fluid coating material, comprising directing the web along a processing path from an upstream supply position to a downstream product position, and intermediate the upstream and downstream positions, carrying out the steps of:

contacting the web upper main surface upstream of the transfer roll with a wrap roll to feed the web to the transfer roll at an orientation to the outer surface defining an included acute angle between the web and the outer surface of the tranfer roll;

rotating the transfer roll at a selected rotation to translate the lower portion of the transfer roll outer surface to an upper non-immersed web coating application position;

engaging the web with the transfer roll outer surface at such upper non-immersed web coating application position to transfer coating material from the transfer roll to the web from a resin-coated web;

contacting the upper main surface of the resin-coated web downstream of the transfer roll with a squeegee roll to thereby control the coating material thickness on the web; and discharging the resin-coated web from the squeegee roll.

In the method of the invention broadly described above, a stepped doctor roll may be reposed in abutting shoulder contact with the outer surface of the transfer roll at a position which is intermediate the lower partially immersed position of the outer surface of the transfer roll and the upper non-immersed web coating application position, to establish a selected thickness of coating material on the outer surface of the transfer roll.

In relation to the coating systems of the prior art for coating webs with coating material by a transfer roll, the apparatus and method of the present invention provide improved control of the coating thickness, reduced waste of the coating material, and accurate control of the contact angle of the web with the transfer roll.

Other aspects, features and embodiments of the invention will be more fully apparent from the ensuing disclosure and appended claims.

DETAILED DESCRIPTION OF THE INVENTION AND PREFERRED EMBODIMENTS THEREOF

Figure 1:
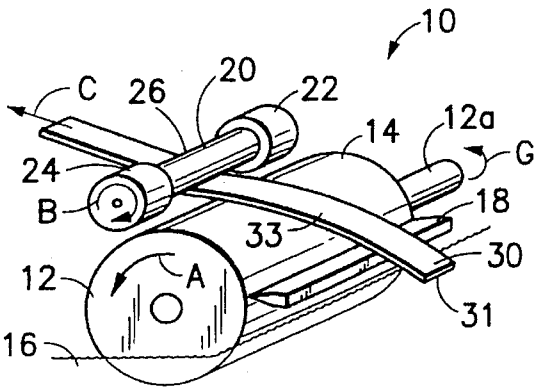
FIG. 1 is a simplied perspective view of a web coating apparatus according to one embodiment of the present invention.

The coating system of the present invention permits the efficient coating of webs by a transfer roll coating arrangement with accurate and reproducible control of the thickness and uniformity of the coating on the web, which as indicated above achieves improvement in reduced waste of coating material.

The webs which may be coated in the broad practice of the invention include any suitable sheet or ribbon-form material which are amenable to roller coating. Typically such webs are of elongate character and substantially uniform width, being furnished from a supply roll or other feed stock source, and fed through the process system including the transfer roll, for contact with the outer surface of the transfer roll to transfer the coating medium to the web, and subsequent discharge from the transfer roll to downstream processing steps, and ultimate collection, as for example by a take-up roll or other collection means.

The web may therefore be of any suitable type and dimensional character, including varying thicknesses, and formed of materials including woven, non-woven, molded, solid, foraminous, imperforate, organic, inorganic, natural, synthetic, metal. mineralic, monolithic, composite, or any other type and/or form of materials which are coatable, impregnable, or otherwise treatable with the coating medium.

Illustrative web materials of construction include glass, polymeric, ceramic, pre-oxidized carbon, and non-conductive carbon materials, nylon, rayon, polyester, polyetherimide, polyethylene, polyphenylenesulfide, polyetherketone, polylactic acid, acetate, starch doped polyethylene, modified polybutylene terephthalate, hydrolyzable nylon, chitosan, chitosan acetate, polyglycolic acid, polycaprolactone, sugar, and polyvinyl alcohol.

Illustrative examples of potentially useful polymeric materials of construction for webs include cotton, wool, silk, hemp, flax, hair, mohair, ramie, cellulosics, polyethylene, polyester, polyacrylonitrile, and polymeric fibers commercially available under the trademarks Tencel®, Mater-Bi®, Novon®, Biopol®, Cellulon®, Kevlar® and Kynol®.

Naturally occurring fibers, such as fibers of cotton, wool, silk, hemp, hair, flax, mohair, ramie, and unrefined cellulosics, may advantageously be employed in webs of woven or unwoven fibrous character.

In a specific embodiment of the invention, the web may be formed as a multifilament web, in woven, non-woven, or other suitable fiber-comprising form.

In a preferred aspect of the invention, the web comprises a multi filament web of fibers of suitable material which is coated on the transfer roll with an impregnant medium which may for example comprise a curable resin formulation, whereby the impregnated web may be suitably shaped or formed into a desired conformation, and then subjected to appropriate curing conditions. e.g., heat and pressure consolidation conditions, for forming a cured composite body. The web of such type may be consolidated with other resin-impregnated webs or fiber tow assemblies, and formed into a prepreg to produce, when fully cured, a multilaminate composite product structure.

In a highly preferred embodiment, the web comprises a multifilament web which is constituted of filament, strand or fiber elements, of materials such as glass, carbon (including graphite as well as non-graphitic, e.g., vitreous, carbon), metal, polymer, ceramic or other natural or synthetic materials.

The coating composition which is applied to the web may comprise a resin composition, such as ester, phenolic, silicone, furan, and acrylic resins, as well as multicomponent resins described in U.S. Pat. No. 4,892,764 issued Jan. 9, 1990 to K. Drain, et al., the disclosure of which hereby is incorporated herein by reference.

Referring now to the drawings, FIG. 1 is a simplified schematic illustration of a web coating apparatus 10 according to one embodiment of the invention.

In this apparatus, the transfer roll 12 is mounted for rotation on shaft 12*a*. The shaft 12*a* in turn is joined by suitable gearing and power transmission means to a source of motion power, such as an electric motor (not shown), to rotate the shaft in the direction indicated in FIG. 1 by arrow "G." By such rotation of the shaft 12*a*, the transfer roll 12 is driven in the direction indicated by arrow "A. The transfer roll 12 has an outer surface 14 extending circumferentially about the radially outer extremity of the roll, which may be of conventional fabrication as a hollow drum or other structure defining and presenting the outer surface 14.

As shown, the transfer roll is partially immersed at its lower portion, and correspondingly the lower portion of the outer surface 14 of the roll, in a fluid coating medium 16 which may be contained in a suitable vessel or container presenting a bath of the coating medium to the outer surface of the transfer roll.

By such arrangement, as the transfer roll is rotated in the direction indicated by arrow A in FIG. 1, the coating medium from the bath contacts and coats the outer surface of the transfer roll. As the coated portion of the outer surface resulting from such immersion translates upwardly to an upper coating material transfer position of the transfer roll (at which the formerly lower portion of the roll is rotated to an upper position for contacting with the web), it passes through an intermediate position at which the resin deposited on the outer surface is contacted with the doctor blade 18, which is positioned in sufficiently close proximity to the outer surface so as to wipingly remove any excess coating material from the outer surface of the transfer roll.

Alternatively, the doctor blade may be replaced in the broad practice of the invention, in instances in which the coating medium requires wiping removal, with a doctor roll, or other member which serves to contact and remove the excess coating material from the outer surface of the transfer roll. In instances where the coating material is of an appropriate viscosity and surface tension character, it may be satisfactory to operate the transfer roll without the provision of any wiping removal means associated therewith.

The resin-bearing outer surface of the transfer roll is therefore rotated to an upper resin transfer position of the roll where the resin-bearing outer surface is contacted with the web 30 being translated along the processing path in the direction indicated in FIG. 1 by arrow "C." By such contact, the main bottom surface 31 of the web is coated with the coating medium. In the case of a multifilament tow or ribbon, the web may by such coating be impregnated by the coating medium, e.g., a resin, with the resin passing into the interstices of the web, to provide thorough coating of the component fibers of the web with the impregnant medium.

Alternatively, the coating medium may be a treating reagent which is contacted with the surface of the fibers in a filamentous tow to effect sizing of the component fibers, or to effect a surface reaction for subsequent downstream processing of the multifilament array. It will be apparent that the coating medium which is applied to the web by the transfer roll may be widely varied in the practice of the invention, and comprise any fluid, flowable, or transferrable medium which is efficacious in application to the web contacted with the transfer roll.

Downstream of the transfer roll 12 in the FIG. 1 system, the main upper surface 33 of the web is contacted with a lower portion of the squeegee roll 20. The squeegee roll 20 is a step roll, being constructed with a smaller diameter main cylindrical portion 26 and lager diameter shoulders 22 and 24 as shown. The squeegee roll is mounted for rotation in the direction "B," and such rotation may be induced by the translational movement of the web (i.e., the squeegee roll may be "free-wheeling" or passively driven by the travel of the web across the main cylindrical medial portion 26 of the roll), as for example by a journalled arrangement of a shaft on which the squeegee roll is mounted, or the squeegee roll may be actively driven in the direction indicated by arrow "B" (by means not shown).

The squeegee roll 20 in the FIG. 1 system is maintained in spaced-apart relationship to the transfer roll, and it may be desirable in some applications to provide the squeegee roll with means for repositioning the squeegee roll about the periphery of the outer surface of the transfer roll, but in spaced relationship thereto, so that the angle at which the web contacts the outer surface of the transfer roll is correspondingly variable, to achieve the optimum effect from the squeegee roll in a given use application of the coating system of the invention.

By imparting tensional action on the web being contacted with the medial cylindrical portion of the squeegee roll, the squeegee roll functions to limit the thickness of the applied coating material on the web. Further, the stepped configuration of the squeegee roll serves to guide the resin-coated web (by marginal confinement of the web between the shoulders of such roll), to maintain proper alignment of the web along the travel path associated with the roller coating system.

It may be desirable in the construction of the system shown in FIG. 1 to tensionally bias the squeegee roll toward the transfer roll. Such tensional biasing could be effected, for example, by attaching a spring element in tension between a shaft of the squeegee roll, and the shaft 12*a* of the transfer roll, with the spring element at its attachment ends being joined by collar or bearing members so as to maintain the spring in constant tension-exerting position despite the rotation of the respective rolls and their associated shales.

Figure 2:
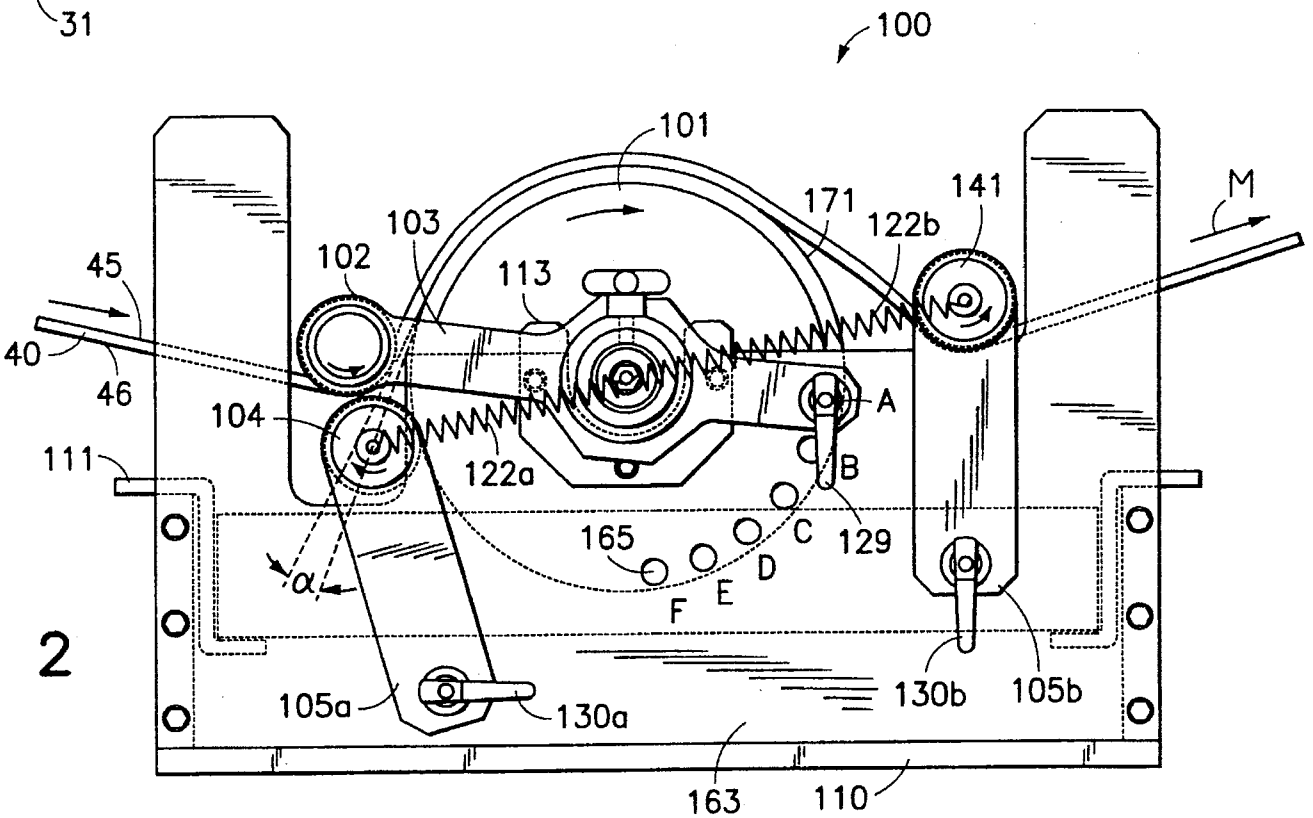
FIG. 2 is a side elevation view of a web coating device according to another embodiment of the present invention.

FIG. 2 illustrates a coating system 100 according to another embodiment of the invention, and shows the web 40 to be coated as having upper main web surface 45 and lower main web surface 46.

The web 40 enters the process system shown in FIG. 1 and is translated in the direction indicated by arrow M along the web processing path. The web passes around the wrap roll 102 on the lower portion of the outer surface of such roll. The wrap roll is adjustably positionable by means of the pivot arm assembly 103 mounted on the retainer bearing 113.

The pivot arm assembly 103 comprises two radially extending arms as shown, with the left-hand arm in the drawing shown as mounting the wrap roll, and with the right-hand arm being securable in a selected position on the side plate 163, by means of pivot arm ball lock pin 129 featuring an L-shaped handle for ready manual movement of the ball lock pin mechanism. As shown, the side plate 163 features a series of arcuately spaced-apart ball lock pin engagement openings A, B, C, D, E, and F (with the ball lock pin in the drawing shown as being positioned in the opening A), and by releasing the ball lock pin, the pivot arm assembly can be rotated to a desired new position.

The position of the wrap roll 102 and the resulting conformation of the web 40 in relation to the outer surface 171 of the transfer roll 101 serves to determine the angle of contact $\alpha$ between the web and the transfer roll at the point of initial contact therebetween, as shown in FIG. 2.

By selectively adjusting the angle of orientation of the pivot arm of the pivot arm assembly, the wrap roll is correspondingly spatially adjusted in position to vary such angle $\alpha$ between the web and the transfer roll. Since the amount of coating material pick-up by the web is dependent on the specific angle of contact, the pivot arm assembly shown permits the adjustment of the wrap roll position to obtain a desired level of coating material pick-up in the operation of the system.

In place of the doctor blade employed in the FIG. 1 system, the FIG. 2 apparatus utilizes a spring-biased doctor roll assembly, comprising doctor roll 104 mounted on swing arm 105*a*, which is pivotally secured in the side plate 163 by means of pivot arm ball lock pin 130*a* featuring an L-shaped handle for ready manual movement of the ball lock pin mechanism.

At its upper part, the swing arm 105*a* has the doctor roll mounted thereon for rotation, and to the shaft of the doctor roll is attached a first end of a spring 122*a*, whose second, opposite end is attached to the shalt of the transfer roll 101. By such arrangement, the doctor roll 104, which is a stepped roll, is tensionally biased by spring 122*a* to contact the outer surface 171 of the transfer roll 101 at the shoulders of the doctor roll.

As a result, the doctor roll controls the thickness of the coating material on the outer surface of the transfer roll, to impart a controlled loading of the coating material to the web subsequently contacting the portion of the outer surface of the transfer roll which has traversed the doctor roll. Thus, the shoulders of the doctor roll are in compressive contact with the outer surface of the transfer roll, to ensure the provision of a uniform film thickness of the coating material on the transfer roll.

At the upper coating material-transfer position of the transfer roll, the web 40 contacts the roll on its main bottom web surface 46 and receives from the outer surface of the transfer roll a transferral of the coating material first picked up by the transfer roll when the specific portion of the outer surface of the transfer roll is submerged in the coating material contained in vessel 111 which is appropriately mounted on the frame structure comprising base 110 and side plate 163.

The coating material thereby is imparted to the web at the upper portion of the transfer roll. The coated web then passes into contact on its main top web surface with the squeegee roll 141, which preferably is a stepped roll. The squeegee roll is mounted for rotation on the swing arm **105*b*, which is pivotally secured in the side plate 163 by means of pivot and ball lock pin 130*b*** featuring an L-shaped handle for ready manual movement of the ball lock pin mechanism.

At its upper part, the swing arm **105*b* has the squeegee roll mounted thereon for rotation, as mentioned aboved, and to the shalt of the squeegee roll is attached a first end of a spring 122*b*, whose second, opposite end is attached to the shaft of the transfer roll 101. By such arrangement, the squeegee roll 141 is tensionally biased by spring 122*b* toward, but in spaced-apart relationship to, the outer surface 171 of the transfer roll 101**.

As a result, the squeegee roll limits the total coating thickness on the web, so that the final product web is discharged from the coating system in the direction M as shown in FIG. 2, for subsequent downstream processing.

The coating system illustratively shown and described with reference to FIG. 2 can be usefully employed to coat a multifilament web with a coating composition comprising a curable resin formulation which may for example comprise an ultraviolet radiation-curable first resin component and a heat-cure, or ambient-cure second resin component. Alter impregnation with such bimodally curable resin formulation, the resin-coated web may be subjected to ultraviolet radiation exposure which is curingly effective to cure the ultraviolet radiation-curable first resin component, and thereby spatially fix the resin and the corresponding embedded fibers of the web, for subsequent curing of the resin by exposure or imposition of cure conditions which are curingly effective for the second resin component, to final cure the resin and thereby form a resulting fiber-resin composite article.

While the invention has been described illustratively hereinabove with reference to various features, embodiments and aspects, it will be recognized that the utility of the invention is not thus limited, and that other modifications, variations, and embodiments are possible, and therefore the invention is to be broadly construed, to encompass all such alternative modifications, variations, and other embodiments within its spirit and scope.

What is claimed is:

1. An apparatus for coating a web having first and second main web surfaces, along a path of travel of the web from an upstream supply position to a downstream position, comprising:

a reservoir for containing a coating material:

a transfer roll having a circumscribing outer surface, and mounted for rotation with a lower portion of the outer surface positioned for immersion in the reservoir to contact coating material therein to transfer coating material to the immersed outer surface so that upon rotation of the transfer roll a coating material-bearing outer surface portion of said transfer roll is rotated into coating material-transferring contact with the web on the first main surface thereof, when the web contacts the upper portion of the outer surface of the transfer roll along said path; and a stepped squeegee roll assembly comprising (i) a stepped squeegee roll mounted downstream of said transfer roll, so that the web in passage away from the transfer roll on said path is contacted by the stepped squeegee roll on the second main surface of the web, and (ii) tensional biasing means coupled with the stepped squeegee roll so that the stepped squeegee roll is tensionally biased toward, but in spaced relationship to, the transfer roll, whereby the stepped squeegee roll functions to maintain alignment of the web on the transfer roll, and to limit the coating material thickness on the web.

2. An apparatus according to claim 1, further comprising a stepped, tensionally biased doctor roll, in bearing contact at marginal shoulder portions thereof with the outer surface of the transfer roll at an intermediate position of the transfer roll outer surface between the immersed lower portion of the outer surface and the upper portion of the outer surface of the transfer roll, to thereby controllably establish coating material thickness on the transfer roll outer surface.

3. An apparatus according to claim 1, further comprising a wrap roll with which the web is contacted on the second main web surface in approach to the transfer roll, wherein the wrap roll is mounted in spaced relation to the transfer roll.

4. An apparatus according to claim 3, comprising a pivot arm assembly comprising a pivot arm mounting said wrap roll and means for selectively positioning the pivot arm and mounted wrap roll, to control the arc of contact of the web with the outer surface of the transfer roll.

5. An apparatus for coating with a coating material a web having upper and lower main web surfaces, wherein the apparatus comprises:

a reservoir for containing the coating material;

a rotatable transfer roll with an outer surface for transferring coating material thereon to a web contacting the roll during rotation thereof, with the transfer roll being mounted in the reservoir with a lower portion of the outer surface arranged for immersion in coating material contained therein, and so that upon rotation of the transfer roll a lower portion of the outer surface after immersion in the coating material is rotated to a non-immersed web coating application position of the transfer roll for contacting the web;

a drive assembly for rotating the transfer roll;

the web being arranged for translation from an upstream supply position to a downstream position along a processing path, so that the lower main web surface along the processing path contacts the transfer roll at the non-immersed web coating application position of the roll;

a wrap roll assembly comprising (i) a wrap roll positioned upstream in spaced relationship to the transfer roll and in contact with the upper main web surface, and (ii) wrap roll angular positioning means for adjustably fixing an arc of contact of the web against the transfer roll at the non-immersed web coating application position of the transfer roll;

a stepped squeegee roll mounted so as to be tensionally biased toward, but in spaced relationship to the transfer roll, for limiting coating material thickness on the web; and a stepped doctor roll mounted so as to be tensionally biased toward, and in shoulder contacting relationship to the transfer roll, for controllably establishing coating material thickness on the transfer roll outer surface.

6. An apparatus according to claim 5, wherein the squeegee roll and the doctor roll are mounted for selectively repositionable angular orientation about the transfer roll, to thereby vary the positional relationship of the squeegee roll and doctor roll to the transfer roll.

7. An apparatus according to claim 6, wherein each of the squeegee and doctor rolls is mounted on a pivot arm assembly comprising a pivot arm which is selectively adjustable in orientation, and means for lockingly securing the pivot arm in a selected position.

8. An apparatus according to claim 5, which is of a unitary construction, comprising a base structure on which the reservoir for coating material is mounted, said base structure having upwardly extending side and end plates, with the rolls mounted on the side plates of the base structure for rotation.

9. A process for coating a web with a coating of resin, having upper and lower main web surfaces, with a coating material on a transfer roll with an outer surface partially immersed at a lower portion thereof in a fluid coating material, comprising directing the web along a processing path from an upstream supply position to a downstream product position, and intermediate the upstream and downstream positions, carrying out the steps of:

rotating the transfer roll at a selected rotation to translate the lower portion of the transfer roll outer surface to an upper non-immersed web coating application position;

engaging the web with the transfer roll outer surface at such upper non-immersed web coating application position to transfer coating material from the transfer roll to the web to form a resin-coated web;

contacting the upper main surface of the resin-coated web downstream of the transfer roll with a stepped squeegee roll that is tensionally biased toward the transfer roll to thereby control the coating material thickness on the web; and discharging the resin-coated web from the squeegee roll.

10. A method according to claim 9, further comprising contacting the web upper main surface upstream of the transfer roll with a wrap roll to feed the web to the transfer roll at an orientation to the outer surface defining an included acute angle between the web and the outer surface of the tranfer roll.

11. A process for coating a web with a coating of resin, having upper and lower main web surfaces, with a coating material on a transfer roll with an outer surface partially immersed at a lower portion thereof in a fluid coating material, comprising directing the web along a processing path from an upstream supply position to a downstream product position, and intermediate the upstream and downstream positions, carrying out the steps of;

rotating the transfer roll at a selected rotation to translate the lower portion of the transfer roll outer surface to an upper non-immersed web coating application position;

engaging the web with the transfer roll outer surface at such upper non-immersed web coating application position to transfer coating material from the transfer roll to the web to form a resin-coated web;

contacting the upper main surface of the resin-coated web downstream of the transfer roll with a squeegee roll to thereby control the coating material thickness on the web;

reposing a stepped doctor roll so that its abutting shoulder is in contact with the outer surface of the transfer roll at a position which is intermediate the lower partially immersed position of the outer surface of the transfer roll and the upper non-immersed web coating application position, to establish a selected thickness of coating material on the outer surface of the transfer roll and;

discharging the resin-coated web from the squeegee roll.

* * * * *

UNITED STATES PATENT AND TRADEMARK OFFICE

CERTIFICATE OF CORRECTION

PATENT NO. : 5,607,728

DATED : March 4, 1997

INVENTOR(S) : Bremmer et al.

It is certified that error appears in the above-indentified patent and that said Letters Patent is hereby corrected as shown below:

Column 4, Line 37 following the word "unitary" insert "construction, comprising a frame or base structure on which the reservoir for coating"

Column 6, Line 15 "multi filament web" should be --multifilament web--

Column 7, Line 39 "and lager diameter" should be --and larger diameter--

Signed and Sealed this

Seventeenth Day of June, 1997

Bruce Lehman

*Attest:*

BRUCE LEHMAN

*Attesting Officer*

*Commissioner of Patents and Trademarks*